United States Patent [19]

Akiyama et al.

[11] Patent Number: 4,685,037

[45] Date of Patent: Aug. 4, 1987

[54] SPRING LOADED RECESSED LIGHTING FIXTURE THERMAL PROTECTION

[75] Inventors: Steven R. Akiyama, Park Forest; Ronald C. Zaker, Burbank; Curtis C. Shoup, Lindenhurst, all of Ill.

[73] Assignee: Cooper Industries, Inc., Houston, Tex.

[21] Appl. No.: 676,508

[22] Filed: Nov. 29, 1984

[51] Int. Cl.[4] ..... F21V 25/00

[52] U.S. Cl. ..... 362/276; 362/294; 362/365; 362/373; 362/375; 337/113; 337/381

[58] Field of Search ..... 362/276, 294, 364, 365, 362/373, 375; 248/57, 207, 343; 315/118, 119; 337/85, 113, 381, 380

[56] References Cited

U.S. PATENT DOCUMENTS

| | | | |
|---|---|---|---|
| 4,314,223 | 2/1982 | Kristofek | 337/381 X |
| 4,358,635 | 11/1982 | Druffel | 174/101 |
| 4,388,677 | 6/1983 | Druffel | 362/364 X |
| 4,396,898 | 8/1983 | Tibolla | 337/113 |
| 4,408,262 | 10/1983 | Kusmer | 362/364 X |
| 4,420,802 | 12/1983 | Smester et al. | 362/364 |
| 4,450,512 | 5/1984 | Kristofek | 362/364 X |
| 4,460,944 | 7/1984 | Gordbegli et al. | 362/364 X |

*Primary Examiner*—Willis R. Wolfe, Jr.
*Attorney, Agent, or Firm*—E. E. Scott; A. R. Thiele

[57] ABSTRACT

An arrangement for mounting a thermal protective device on the outer surface of a housing of a recessed lighting fixture includes a plaster frame having a horizontal portion and a depending portion formed integrally with the horizontal portion. The plaster frame is adapted for mounting in a ceiling opening. A housing has a lamp connected to a source of electrical power and is adapted for mounting within the depending portion of the frame. A thermal protective device is connected in series with the lamp for interrupting the current from the source of electrical power when the temperature on the outer surface of the housing exceeds a predetermined temperature. A retaining device is provided for holding the thermal protective device against the outer surface of the housing to sense the temperature thereon.

20 Claims, 6 Drawing Figures

SPRING LOADED RECESSED LIGHTING FIXTURE THERMAL PROTECTION

BACKGROUND OF THE INVENTION

This invention relates generally to thermal protective devices for recessed lighting fixtures and more particularly, it relates to an arrangement for mounting a thermal protective device in a spring loaded manner on the outer surface of the housing wall of a recessed lighting fixture.

In the lighting industry, it has been encountered heretofore that recessed lighting fixtures which are mounted in a ceiling surface may become unsafe and overheat at times when lamps larger than the required or recommended wattage are used in the lighting fixture, or when the fixtures are covered with insulating material. This has been known to cause fires where the excess heat generated is not effectively dissipated. In view of this existing condition, safety organizations, such as National Fire Protection Association, and Underwriters Laboratory, have set up requirements for using some type of thermal protective device in lighting fixtures which will automatically shut off the lamp when a predetermined temperature is exceeded. Thus, there has arisen the need of mounting properly and efficiently a thermal protective device in a recessed lighting fixture which will sense accurately the temperature in the vicinity of the light fixture housing so as to prevent overheating of the lighting fixture, thereby avoiding a potential fire hazard.

In U.S. Pat. No. 4,314,223, issued to P. J. Kristofek on Feb. 2, 1982, there is disclosed a thermal protective device for interrupting a current to the lamp circuit of an electrical lighting fixture when the temperature at a preselected location in the fixture reaches a predetermined level. The protective device is comprised of a receptacle member and a plug member adapted for joining with the receptacle member. The protective device is merely suspended within the housing of the lighting fixture.

In U.S. Pat. No. 4,450,512, issued to P. J. Kristofek on May 22, 1984, there is shown an arrangement for mounting a thermal protective device in a recessed lighting fixture which includes a clip-on receptacle adapted for mounting in an aperture formed in the side wall of the housing of the lighting fixture. The receptacle is dimensioned so as to receive and retain a thermal protective device. The case is formed with a projection that defines a window area at which a bimetallic switching element is positioned. The window area is aligned with an opening in the side wall of the lighting fixture housing so as to insure accurate sensing of the temperature on the outer surface thereof.

The present invention represents an improvement over these above-mentioned patents for some types of recessed fixtures in that it includes an arrangement for mounting a thermal protective device in a spring loaded manner on the outside surface of the housing wall of the recessed fixture. The arrangement of the present invention is relatively simple in its construction and is easy to manufacture and assemble.

SUMMARY OF THE INVENTION

Accordingly, it is a general object of the present invention to provide an improved arrangement for mounting a thermal protective device in a spring loaded manner on the outer surface of the housing wall of a recessed lighting fixture.

It is an object of the present invention to provide an arrangement for mounting a thermal protective device adjacent the outer surface of a housing of a recessed lighting fixture which includes retaining means for holding the protective device adjacent the outer surface of the housing to sense the temperature thereon.

It is another object of the present invention to provide an arrangement for mounting a thermal protective device adjacent the outer surface of a housing of a recessed lighting fixture which includes an L-shaped bracket device for holding the protective device in a spring loaded manner adjacent the outer surface of the housing to sense the temperature thereon.

It is still another object of the present invention to provide an arrangement for mounting a thermal protective device adjacent the outer surface of a housing of a recessed lighting fixture which includes a bracket device adapted to rotate and maintain flat engagement with the outer surface of different sized housings.

It is still another object of the present invention to provide an arrangement for mounting a thermal protective device in a spring loaded manner on the outside surface of the housing wall of a recessed lighting fixture which is relatively simple in its construction and is easy to manufacture and assemble.

In accordance with these objectives, the present invention provides an arrangement for mounting a thermal protective device on the outer surface of a housing of a recessed lighting fixture which includes a plaster frame having a horizontal portion and a depending portion formed integrally with the horizontal portion. The frame is adapted for mounting in a ceiling opening. A housing has a lamp connected to a source of electrical power and is adapted for mounting within circular portion of the plaster frame. A thermal protective device is connected in series with the lamp for interrupting the current from the source of electrical power when the temperature on the outer surface of the housing exceeds a predetermined temperature. A retaining device is formed of a holding bracket, a protector bracket and spring for holding the protective device within the protector bracket and for urging the protector bracket into contact with the outer surface of the housing to sense the temperature thereon. The holding bracket is secured to the horizontal portion and the circular portion of the plaster frame.

In accordance with another important aspect of the present invention, the retaining device is formed simply of a flexible wiring channel and a metallic leaf spring. The thermal protective device is positioned at one end of the wiring channel, and the metallic leaf spring is attached to the flexible wiring channel so as to hold the protective device against the outer surface of the housing of the recessed lighting fixture.

In accordance with still another important aspect of the present invention, the retaining device is formed of a coil spring type wireway. With the protective device attached to one end of the coil spring wireway, the spring wireway presses the protective device resiliently forward and down against the outer surface of the housing.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
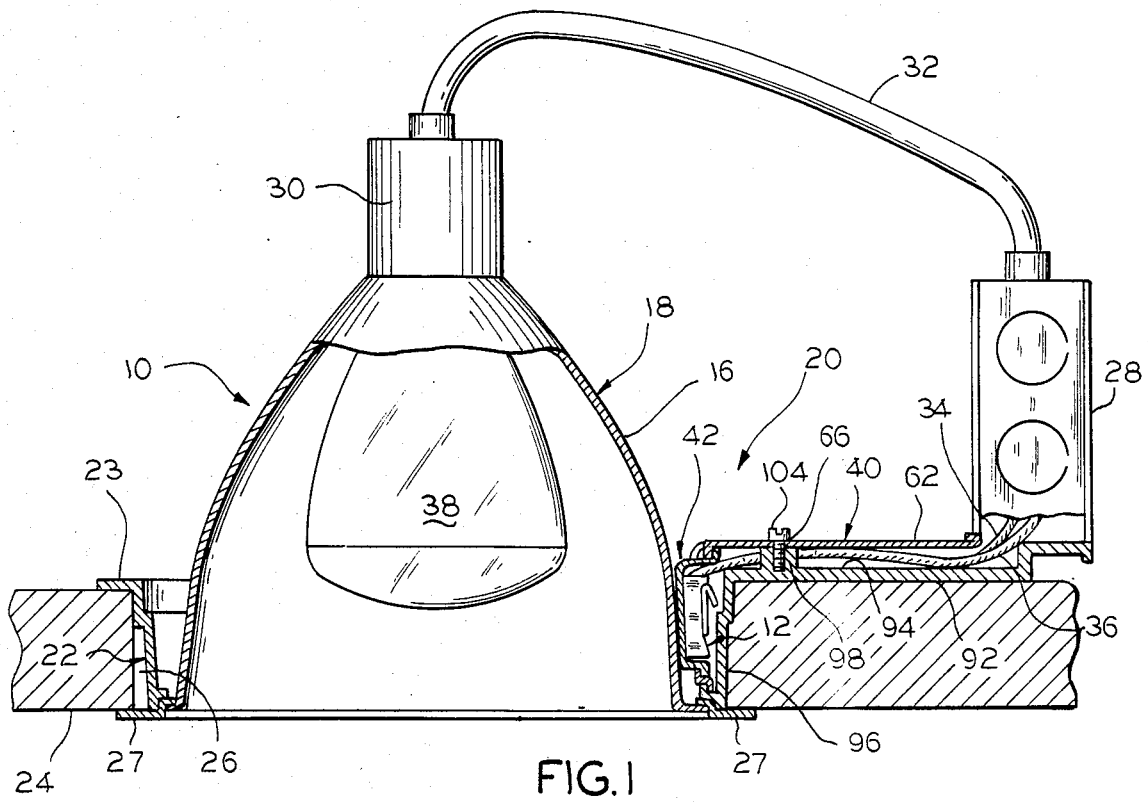
FIG. 1 is a partial cross-sectional side view of an arrangement for mounting a thermal protective device on the outer surface of a lighting fixture housing in accordance with the principles of the present invention.

Referring now in detail to the various views of the drawings, there are illustrated in FIGS. 1-4, a recessed lighting fixture 10 which includes a thermal protective device 12 mounted on the outside surface of a side wall 16 of a lighting fixture housing 18 by means of a mounting arrangement designated generally by the reference numeral 20, according to the present invention. A plaster frame 22 is suitably mounted in an opening 26 in a ceiling or a like member 24. The plaster frame 22 is provided with an annular flange 23 adapted for mounting to a structural member (not shown) for supporting the ceiling 24. Typically, a trim ring 27 is included at the ceiling surface to complete the assembly.

The housing 18 of the lighting fixture is of a conventional design and is shown herein for purposes of illustration in a conical configuration. It will be recognized by those skilled in the art that the configuration of the housing may be oval, circular, or any other shape in its transverse cross-section. The plaster frame 22 is adapted to support the housing 18 therein and to also support at its one end an electrical junction box 28 which supplies the required electrical power to the lighting fixture 10.

A socket assembly 30 is mounted on the top wall of the housing 18 for receiving a lamp 38. Power from the junction box 28 is provided to the socket assembly 30 by means of a flexible armored cable 32 interconnected between the junction box 28 and the socket assembly 30. The thermal protective device 12 is provided with two wires 34,36 which are joined electrically in series between an incoming power lead from the junction box 28 and one side of the lamp 38. The thermal protective device 12 may be one of the various types which are commercially available. The protective device herein uses a temperature-sensitive bimetallic switching mechanism 39 tht opens or breaks the current flowing to the lamp 38 when a predetermined temperature is exceeded. This causes extinguishment of the lamp so as to prevent further generation of heat. Once the housing is cooled sufficiently, the bimetallic mechanism will close again so as to turn on the lamp. The extinguishment of the lamp will tend to avoid the build-up of excessive heat in the lighting fixture which could be sufficient to cause a fire to begin.

Figure 4:
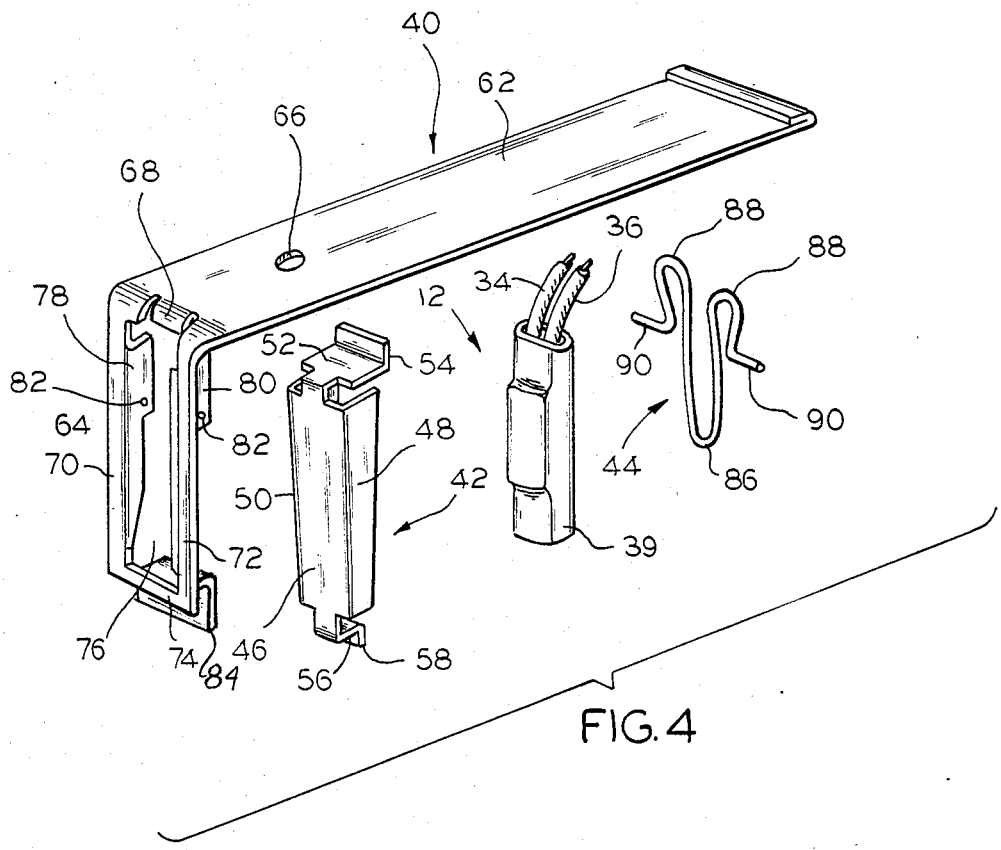
FIG. 4 is an exploded, perspective view of the bracket device according to the present invention illustrating the various components incorporated therein.

A first embodiment of the preferred arrangement 20 for mounting the thermal protective device 12 on the outside surface of the side wall 16 of the housing 18 in a spring loaded manner includes retaining means including an L-shaped holding bracket 40, a protector bracket 42, and a sinusoidally-shaped spring 44 (FIG. 4). The protector bracket 42 includes a rectangularly-shaped front wall 46 and a pair of opposed side walls 48,50 joined integrally to the sides of the front wall 46 forming a generally U or channel shaped structure. A top wall 52 is formed integrally to the top edge of the front wall 46. The top wall 52 is provided with an upwardly extending projection 54. The bottom edge of the front wall 46 is open except for a lower tab 56 having a downwardly extending projection 58. The projections 54,58 engage the holding bracket 40 as will be described more fully hereinafter. The front wall 46 and the opposed side walls 48,50 joined thereto form a partial enclosure or area 60 for recieving the thermal protective device 12.

Figure 3:
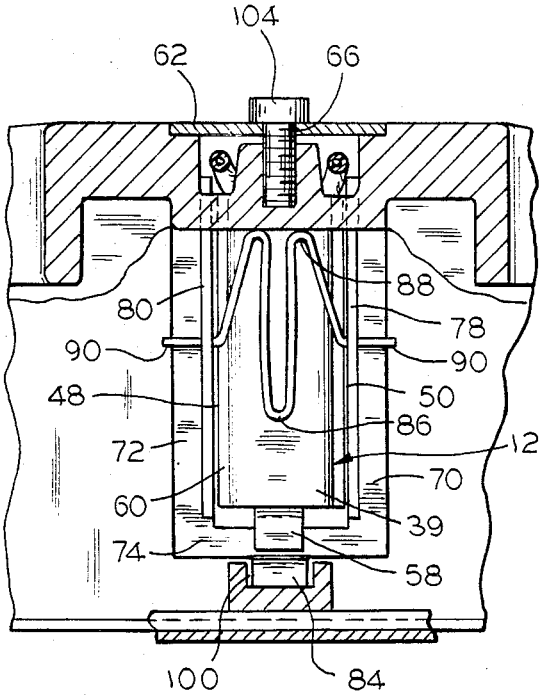
FIG. 3 is a cross-sectional view taken along the line 3—3 of FIG. 2 illustrating the bracket device in an assembled condition.

The holding bracket 40 consists of a flat, horizontal member 62 and a vertical member 64. The horizontal member 62 is provided with an opening 66 and a a downwardly extending tab or projection 68. The vertical member 64 is formed by a pair of narrow vertical front sections 70,72 and a narrow horizontal bottom section 74 for defining a rectangularly-shaped opening 76. A pair of side sections 78,80 extend rearwardly from the respective edges of the front sections 70,72. A pair of small aligned clearance holes 82 are formed in each of the side sections 78,80. The bottom section 74 has a rearwardly extending spring tab 84. As shown in FIGS. 3 and 4, the sinusoidally-shaped spring 44 is formed by a substantially U-shaped mid-portion 86, a pair of coplaner inverted U-shaped portions 88, and a pair of co-planer horizontal side portions 90.

Figure 2:
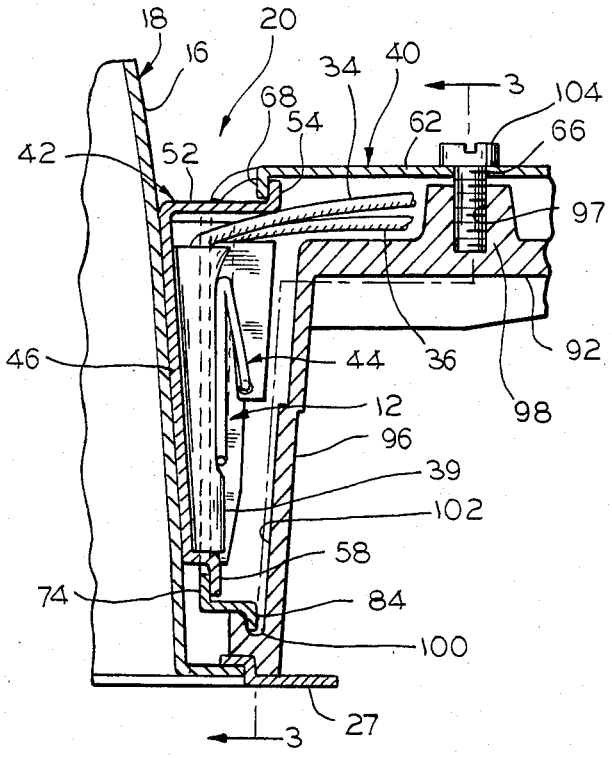
FIG. 2 is an enlarged, fragmentary, crosssectional view of the bracket device forming the mounting arrangement illustrated in FIG. 1.

The plaster frame 22 includes a horizontal portion 92 which supports the junction box 28 and a depending portion 96, usually being a generally ring or circular shape. The horizontal portion 92 is provided with a recessed area 94 which accommodates the wires 34,36 of the thermal protective device. In the intermediate portion of the recessed area 94 adjacent the depending circular portion 96 of the plaster frame, there is provided a circular raised portion 98 which includes a cored hole 97. As shown in FIG. 2, the circular portion 96 of the frame has a U-shaped recessed portion 100 formed on its inner surface 102.

The holding bracket 40 and the protector bracket 42 are preferably constructed of a resilient material having a high coefficient of thermal conductivity, such as sheet metal. This construction enables the bracket components to be formed in a simple bending and stamping operation, thereby effecting a relatively low cost in production. Further, the spring 44 is preferably formed of a spring steel or other similar resilient material.

The mounting arrangement 20, with the protective device 12 installed thereto, is assembled to the plaster frame prior to installation of the plaster frame in the ceiling opening. Thus, a separate step of mounting the protective device after installation of the plaster frame has been eliminated. The assembly of the protective device mounting arrangement to the plaster frame will now be described. Initially, the protector bracket 42 is placed within the rectangular opening 76 in the vertical member 64 of the holding bracket 40. The upwardly extending projection 54 on the top wall 52 of the protector bracket engages the downwardly extending tab 68 on the horizontal member 62 of the holding bracket.

Simultaneously, the downwardly extending projection 58 of the protector bracket engages the narrow, bottom section 74 of the holding bracket. In this position, the side walls 48,50 of the protector bracket 42 are disposed in a parallel relationship to the side sections 78,80 of the holding bracket.

The bimetallic switching mechanism 39 of the protective device is then placed within the area 60 of the protector bracket 42 in intimate heat transfer contact with the inside surface of the front wall 46. The wires 34,36 extend rearwardly from beneath the top wall 52 of the protector bracket 42. Next, the horizontal side portions 90 of the spring 44 are inserted into the pair of small circular clearance openings 82 in the side sections 78,80 of the holding bracket so as to securely fix the protector device 12 and the protector bracket 42 to the holding bracket 40. The holding bracket is now placed onto the plaster frame so that the spring tab 84 is received in the U-shaped recessed portion 100, and the opening 66 is aligned with the cored hole 97 in raised portion 98. Further, the wires 34,36 extend along the recessed area 94 beneath the horizontal member 62 of the holding bracket for connection within the junction box 28. A fastener, such as a screw 104, is inserted through the opening 66 for threaded engagement with the hole 97 so as to securely fix the holding bracket to the plaster frame.

Finally, the lighting fixture housing 18 is inserted and mounted in a suitable manner within the circular portion 96 of the plaster frame. In this position, the resiliency of the spring 44 provides a force sufficient to hold the bimetallic switching mechanism 39 against the inner surface of front wall 46 of the protector bracket 42 and also urges the outer surface of the protector bracket to be in intimate heat transfer contact with the outside surface of the fixture housing 18 so as to accurately sense the temperature thereon.

The protector bracket 42 is adapted to move about the bottom section 74 of the vertical member 64 of the holding bracket. The protector bracket is capable of rotating inwardly toward the center of the circular portion 96 of the plaster frame to insure flat alignment or engagement with the outside surface of the fixture housing. Thus, the protector bracket may accommodate different size housings within a reasonable range.

Figure 5:
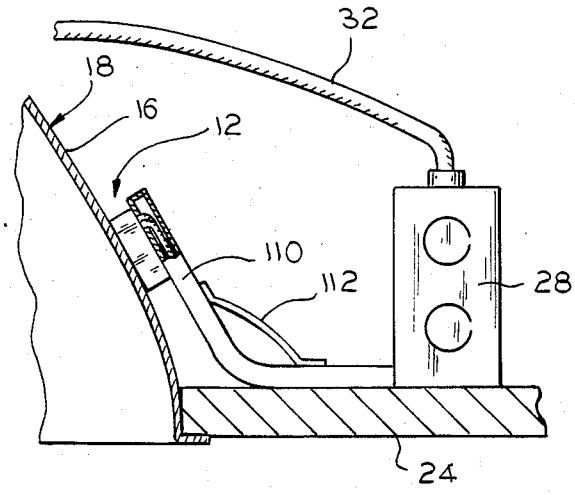
FIG. 5 is a partial cross-sectional side view of a second embodiment of a mounting arrangement according to the present invention.

A second embodiment of the mounting arrangement, in accordance with the present invention, is shown in FIG. 5 of the drawings. As can be seen, the mounting arrangement is defined by retaining means including a flexible wiring channel 110 and a metallic leaf spring 112. The thermal protective device 12 is positioned at a free end of the wiring channel 110. The metalic leaf spring 112 is placed across a portion of the wiring channel 110 so as to push the protective device 12 against the outside surface of the side wall 16 of the fixture housing 18.

Figure 6:
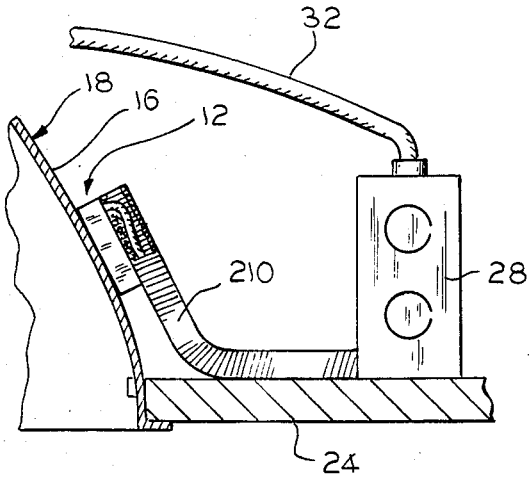
FIG. 6 is a partial cross-sectional side view of a third embodiment of a mounting arrangement according to the present invention.

A third embodiment of the mounting arrangement, according to the present invention, is shown in FIG. 6. The mounting arrangement is defined by retaining means including a coiled spring-type wireway 210. The protective device 12 is attached to a free end of the coiled spring wireway 210. The spring wireway 210 presses the protective device 12 forwardly and downwardly against the outer surface of the side wall 16 of the fixture housing 18.

From the foregoing detailed description, it can thus be seen that the present invention provides improved arrangements for mounting a thermal protective device on the outer surface of a housing of a recessed lighting fixture, and that the mounting arrangements of the present invention are relatively simple in their construction and are easy to manufacture and assemble.

While there has been illustrated and described what are at present considered to be preferred embodiments of the present invention, it will be understood by those skilled in the art that various changes and modifications may be made, and equivalents may be substituted for elements thereof, without departing from the true scope of the invention. In addition, many modifications may be made to adapt a particular situation or material to the teachings of the invention without departing from the central scope therof. Therefore, it is intended that this invention not be limited to the particular embodiments disclosed as the best modes contemplated for carrying out this invention, but that the invention will include all embodiments falling within the scope of the appended claims.

What is claimed is:

1. An arrangement for sensing the temperature on the outer surface of a recessed lighting fixture comprising:

a plaster frame having a horizontal portion in a depending circular portion formed integrally with the horizontal portion, said frame being adapted for mounting in a ceiling opening;

a housing having a lamp connected to a source of electrical power and being adapted for mounting within said depending circular portion of said plaster frame;

a thermal protective device connected in series with the lamp for interrupting the current from the source of electrical power when the temperature on the outer surface of said housing exceeds a predetermined temperature;

a holding bracket formed of a horizontal member and a vertical member being adapted for securement to said plaster frame;

a protector bracket adapted for receiving said thermal protective device therein, said protector bracket being adapted for pivotable engagement with said vertical member of said holding bracket; and a spring being joined to said holding bracket for mounting said thermal protective device within said protector bracket and for biasing said protector bracket into intimate heat transfer contact with the outer surface of the said housing;

whereby the temperature of the outer surface of the housing may be sensed.

2. In a recessed lighting fixture adapted for mounting in a ceiling opening, said recessed lighting fixture including a lamp housing, a lamp connected to a source of electrical power and a thermal protective device connected in series with a lamp for interrupting the current to the lamp from the source of electrical power when the temperature of the outer surface of the housing exceeds a predetermined temperature, the improvement comprising:

a plaster frame having a horizontal portion and a dependent portion formed integrally with the horizontal portion, said frame being adapted for mounting in the ceiling opening;

the lamp housing being adapted for mounting within the dependent portion of said frame; and adjustable retaining means for holding the thermal protective device in intimate heat transfer contact with a variety of lamp housing outer surface designs;

whereby the temperature of the outer surface of the housing is sensed.

3. A mounting arrangement as defined in claim 2, wherein said adjustable retaining means comprises: a flexible wiring channel having a free end, said thermal protective device being attached to said channel at said free end and a metallic leaf spring connected across a portion of said channel for biasing said thermal protective device against the exterior surface of the lamp housing.

4. A mounting arrangement as defined in claim 2, wherein said adjustable retaining means comprises a coiled spring wireway having a free end, said thermal protective device being attached to said free end of said coiled spring wireway, said coiled spring wireway biasing the thermal protector against the outside surface of said housing.

5. A mounting arrangement as defined in claim 2, wherein said adjustable retaining means comprises a holding bracket, a protector bracket and a spring, wherein said spring both holds the thermal protective device within the protector bracket and urges the protector bracket into intimate heat transfer contact with the outer surface of the lamp housing.

6. A mounting arrangement as defined in claim 5, wherein said protector bracket is adapted to pivotably rotate into engagement with the outer surface of the lamp housing.

7. A mounting arrangement as defined in claim 6, wherein said holding bracket is formed of a horizontal member and a vertical member connected to said horizontal member to form a L-shaped structure, said horizontal member having an opening in a downwardly extending projection, said vertical member including a pair of narrow vertical front sections and a narrow horizontal bottom section, said bottom section having a rearwardly extending spring tab whereby said protector bracket may pivot against said narrow horizontal bottom section and pass through said opening.

8. A mounting arrangement as defined in claim 7, wherein said protector bracket has a front wall, a bottom wall, a top wall, a pair of side walls, and a lower spring tab forming an area to receive the thermal protective device, said top wall having an upwardly extending projection, said upwardly extending projection engaging said downwardly extending projection of said holding bracket, said lower spring tab pivotably engaging said bottom section of said holding bracket.

9. A mounting arrangement as defined in claim 8, wherein said front sections on the said vertical member of said holding bracket including a pair of side sections connected to said front sections, said side sections having aligned line clearance holes formed therein, and wherein said spring has a pair of horizontal side portions which are inserted into said aligned clearance holes to secure said protective device in said protective bracket to said vertical member of said holding bracket.

10. A mounting arrangement as defined in claim 9, wherein said horizontal portion of said plaster frame is provided with a circular raised portion having a hole and said depending portion of said plaster frame has a U-shaped recessed portion, and wherein said opening in said horizontal member of said holding bracket is aligned with said circular raised portion and said spring tab on said bottom section of said holding bracket is inserted into said U-shaped recess portion, a screw being inserted through said opening in the horizontal member and into said hole in the raised portion to secure said holding bracket to said frame.

11. An arrangement for mounting a thermal protective device on a recess lighting fixture, comprising:

a plaster frame having a horizontal portion and a depending portion formed integrally with the horizontal portion, said plaster frame being adapted for mounting in a ceiling opening;

a housing containing a lamp, said lamp being connected to a source of electrical power, said housing being adapted for mounting within the depending portion of said frame;

a thermal protective device connected in series with said lamp for interrupting the current from said source of electrical power when the temperature sensed by said thermal protective device exceeds a predetermined temperature;

means for adjustably positioning said thermal protective device in intimate heat transfer contact with the outer surface of said housing, said adjustable positioning means having a holding bracket secured to said plaster frame, a protector bracket pivotably mounted to said holding bracket and a spring for both holding said protective device within said protector bracket and for urging said protector bracket into intimate heat transfer contact with the outer surface of said housing;

whereby the pivotal mounting of said protector bracket with said holding bracket will allow for sensing the temperature of the outer surface of the housing with a variety of housing outer surface designs.

12. A mounting arrangement as defined in claim 11, wherein said thermal protective device includes a bimetallic switching mechanism.

13. A mounting arrangement as defined in claim 11, wherein said horizontal portion of said plaster frame supports a junction box.

14. A mounting arrangement as defined in claim 11, wherein said horizontal portion of said plaster frame has a recessed area to accommodate wires of said thermal protective device for connection to a junction box.

15. A mounting arrangement as defined in claim 11, wherein said holding bracket and said protector bracket are formed of a resilient material having a high coefficient of thermal conductivity.

16. A mounting arrangement as defined in claim 11, wherein said protector bracket is adapted to rotate into engagement with said outer surface of said housing.

17. A mounting arrangement as defined in claim 16, wherein said holding bracket is formed of a horizontal member and a vertical member connected to said horizontal member to form a L-shaped structure, said horizontal member having an opening and a downwardly extending projection, said vertical member including a pair of narrow vertical front sections and a narrow horizontal bottom section, said bottom section having a rearwardly extending spring tab, said protector bracket being pivotable against said narrow horizontal bottom section and rotatable through said opening.

18. A mounting arrangement as defined in claim 17, wherein said protector bracket has a front wall, a top wall, a pair of side walls and a lower spring tab forming an area to receive said thermal protective device, said top wall having an upwardly extending projection, said upwardly extending projection engaging said downwardly extending projection of said holding bracket, said lower spring tab pivotably engaging said bottom section of said holding bracket.

19. A mounting arrangement as defined in claim 18, wherein said front sections on said vertical member of said holding bracket include a pair of side sections connected to said front sections, said side sections having a pair of aligned clearance holes formed therein, and wherein said spring has a pair of horizontal side portions which are inserted into said aligned clearance holes to bias said thermal protective device and said protector bracket through said vertical member of said holding bracket.

20. A mounting arrangement as defined in claim 19, wherein said horizontal portion of said plaster frame is provided with a circular raised portion including a threaded hole and said circular raised portion of said frame has a U-shaped recess portion, and wherein said opening in said horizontal member of said holding bracket is aligned with said circular raised portion and said spring tab on said bottom section of said holding bracket is inserted into said U-shaped recess portion, a screw being inserted through said opening into said horizontal member and into said threaded hole in said raised portion to secure said holding bracket to said plaster frame.

* * * * *